US011333351B2

(12) United States Patent
Tonomura et al.

(10) Patent No.: US 11,333,351 B2
(45) Date of Patent: May 17, 2022

(54) SUPERHEATED STEAM GENERATOR

(71) Applicant: TOKUDEN CO., LTD., Kyoto (JP)

(72) Inventors: Toru Tonomura, Otsu (JP); Yasuhiro Fujimoto, Kyoto (JP)

(73) Assignee: TOKUDEN CO., LTD., Kyoto (JP)

( * ) Notice: Subject to any disclaimer, the term of this patent is extended or adjusted under 35 U.S.C. 154(b) by 322 days.

(21) Appl. No.: 16/562,016

(22) Filed: Sep. 5, 2019

(65) Prior Publication Data

US 2020/0080719 A1 Mar. 12, 2020

(30) Foreign Application Priority Data

Sep. 11, 2018 (JP) ..... JP2018-169420

(51) Int. Cl.

*F22G 1/16* (2006.01)
*H05B 6/10* (2006.01)
*F22B 1/28* (2006.01)

(52) U.S. Cl.

CPC ..... *F22G 1/165* (2013.01); *F22B 1/282* (2013.01); *H05B 6/108* (2013.01)

(58) Field of Classification Search

CPC . A47B 2210/06; A47B 2210/08; A47B 77/16; A47B 88/919; F22B 1/282; F22G 1/165; F22G 3/002; H05B 6/108
USPC ..... 219/629
See application file for complete search history.

(56) References Cited

U.S. PATENT DOCUMENTS

2016/0273759 A1* 9/2016 Tonomura ..... F22B 1/281

FOREIGN PATENT DOCUMENTS

| | | | |
|---|---|---|---|
| EP | 2999309 | A1 | 3/2016 |
| JP | 2012163229 | A | 8/2012 |
| JP | 2012163230 | A | 8/2012 |
| JP | 2015135231 | A | 7/2015 |
| JP | 2016219376 | * | 12/2016 |
| JP | 2016219376 | A | 12/2016 |

OTHER PUBLICATIONS

European Patent Office, Extended European Search Report Issued in Application No. 19196375.0, dated Feb. 10, 2020, Germany, 6 pages.

* cited by examiner

*Primary Examiner* — Dana Ross
*Assistant Examiner* — Joseph W Iskra
(74) *Attorney, Agent, or Firm* — Alleman Hall Creasman & Tuttle LLP

(57) ABSTRACT

The present invention is intended to prevent lifetime degradation of a conductor tube by reducing heat deterioration at output ports of the conductor tube. A superheated steam generator generates superheated steam by heating steam flowing through a spirally wound cylindrical conductor tube. The conductor tube is axially short-circuited and subjected to induction heating by a magnetic flux generation mechanism disposed on one or both of inner and outer sides of the conductor tube. Output ports of the conductor tube are disposed at axial midportions of the conductor tube.

10 Claims, 9 Drawing Sheets

SUPERHEATED STEAM GENERATOR

BACKGROUND OF THE INVENTION

Field of the Invention

The present invention relates to a superheated steam generator.

Background Art

Patent Document 1 describes a superheated steam generator which includes a magnetic field generation mechanism disposed inside or outside a spirally wound cylindrical conductor tube. The conductor tube is subjected to induction heating by the magnetic field generation mechanism, so that steam flowing through the conductor tube is heated to generate superheated steam. Winding parts adjacent to each other in the conductor tube are electrically connected to each other into a secondary single-turn coil as a whole. The conductor tube includes an input port for inputting steam and an output port for outputting superheated steam. The input port is disposed at one end portion in an axial direction of the conductor tube. The output port is disposed at the other end portion in the axial direction.

However, the induction heating of the conductor tube causes an increase in current density in the vicinity of the input port disposed at the axial one end portion and in the vicinity of the output port disposed at the axial other end portion as illustrated in FIG. 9. Consequently, a temperature in the vicinity of the output port and a temperature in the vicinity of the output port may become higher than that in other portions. In other words, the vicinity of the output port and the vicinity of the output port may be locally heated. When steam is inputted to the input port and heated superheated steam is outputted from the output port in the conductor tube thus heated, because of a high temperature of the superheated steam, a locally heated part in the vicinity of the output port may have a higher temperature. The locally heated part may be subjected to heat deterioration, resulting in a short lifetime of the conductor tube.

PRIOR ART DOCUMENT

Patent Document

Patent Document 1: Japanese Unexamined Patent Publication No. 2012-163230

SUMMARY OF THE INVENTION

Problems to be Solved by the Invention

The present invention has been made to solve the above problem and has a main object of preventing lifetime degradation of a conductor tube by reducing heat deterioration at output ports of the conductor tube.

Means for Solving the Problems

In one of embodiments of the present invention, a superheated steam generator generates superheated steam by heating steam. The superheated steam generator comprises a spirally wound cylindrical conductor tube through which the steam flows, and a magnetic flux generation mechanism disposed on one or both of inner and outer sides of the conductor tube. The conductor tube is axially short-circuited and subjected to induction heating by the magnetic flux generation mechanism to thereby generate the superheated steam. An output port of the conductor tube is disposed at an axial midportion of the conductor tube. The term "axial midportion" in the present invention indicates portions of the conductor tube excluding both axial end portions, namely, portions inside an axial outermost winding part of the conductor tube.

With the above configuration, because the output port in the cylindrical conductor tube subjected to induction heating is disposed at the axial midportion of the conductor tube, the position of the output port can be separated from both end portions that are locally heated by the induction heating. Both of the locally heated end portions are less susceptible to heat deterioration due to further heating by the superheated steam. It is consequently possible to prevent lifetime degradation of the conductor tube.

Both axial end portions are to be locally heated in the cylindrical conductor tube. However, by introducing steam before being heated from a locally heated portion or from the vicinity thereof, temperatures at both axial end portions can be held at low temperatures. For this purpose, input ports of the conductor tube are preferably disposed at both axial end portions of the conductor tube.

As a specific embodiment of the conductor tube, the conductor tube is preferably divided at an axial midportion into two conductor tube elements, the input ports are preferably disposed at an axial outer end portion of each of the conductor elements, and the output port is one of two output ports preferably disposed at an axial inner end portion of each of the conductor elements.

With this configuration, the cylindrical conductor tube is obtainable and the input ports and the output ports can be disposed at desired positions by axially arranging the two spirally wound conductor tube elements.

Preferably, the winding parts of the conductor tube elements adjacent to each other are electrically connected to each other and opposing parts of the two conductor tube elements adjacent to each other are electrically connected to each other so as to configure a short circuit in the conductor tube as a whole.

With this configuration, potentials of the conductor elements can be held low to prevent occurrence of an accident.

Opposing parts of the two conductor tube elements, excluding the output ports, are preferably joined together by a first conductive joining element along an entire circumferential direction.

With this configuration, current flowing through the conductor tube elements can be made uniform in the circumferential direction, thereby reducing local heating. Additionally, when the two conductor tube elements have substantially the same configuration, such as length, the opposing parts joined together by the first joining element have similar temperatures. This contributes to reducing mechanical power, such as a difference in thermal elongation. The conductor tube is therefore less likely to deteriorate.

The output port of each of the conductor tube elements is preferably formed by bending an axial inner end portion of each of the conductor tube elements at a radius of curvature that is two times a tube diameter.

With this configuration, the output ports are formed by bending at the radius of curvature that is two times the tube diameter, which is a limit radius of curvature (minimum bending radius) that does not cause significant crush of the tube. The two output ports can therefore be disposed adjacently to minimize clearance between the two conductor tube elements. Consequently, current density is less likely to increase locally, thereby reducing local heating.

In order to make it easy to lay external piping when using the superheated steam outputted from the output ports, the output ports of the two conductor tube elements are preferably disposed contactedly or adjacently each other.

The two output ports are preferably joined together by a second conductive joining element. By so joining the two output ports to carry out electrical short circuiting, current goes around and flows through joined parts. Current density is therefore less likely to increase locally, thereby reducing local heating.

The joined parts obtained by the second joining element are intended to configure the short circuit so as to allow a current to flow. Specifically, the joining by the second joining element contributes to reducing the current flowing into the winding parts adjacent to the winding parts where the output ports are located. Because a value of current flowing through the joined part is equal to that in the conductor tube, a short-circuit current value close to that in an undivided state can be ensured by such a configuration that a total cross-sectional area in an energizing direction of the second joining element is greater than a conductor cross-sectional area of the conductor tube. Additionally, because the second joining element is composed of a material which is equivalent to that of the conductor tube or has substantially equivalent physical properties to that of the conductor tube, mechanical characteristics, such as thermal elongation, can also be made to be equivalent thereto while ensuring an electrical resistance lower than that of the conductor tube.

Axially divided induction coils in the magnetic flux generation mechanism may cause local heating at the axial end portions of the induction coil. Therefore, at least one of the magnetic flux generation mechanisms is preferably disposed on an opposite side of a pullout side of the output port, and the at least one magnetic flux generation mechanism preferably has an integral structure without being divided axially.

With this configuration, it is possible to reduce the local heating on the opposite side of the pullout side of the output port.

Effects of the Invention

With the present invention configured as described above, the lifetime degradation of the conductor tube can be prevented by reducing the heat deterioration at the output ports of the conductor tube.

MODE FOR CARRYING OUT THE INVENTION

One of embodiments of a superheated steam generator in the present invention is described below with reference to the drawings.

1. Apparatus Configuration

The superheated steam generator 100 in the present embodiment is intended to generate superheated steam exceeding 100° C. (200-2000° C., for example) by heating steam generated on the outside thereof.

Figure 1:
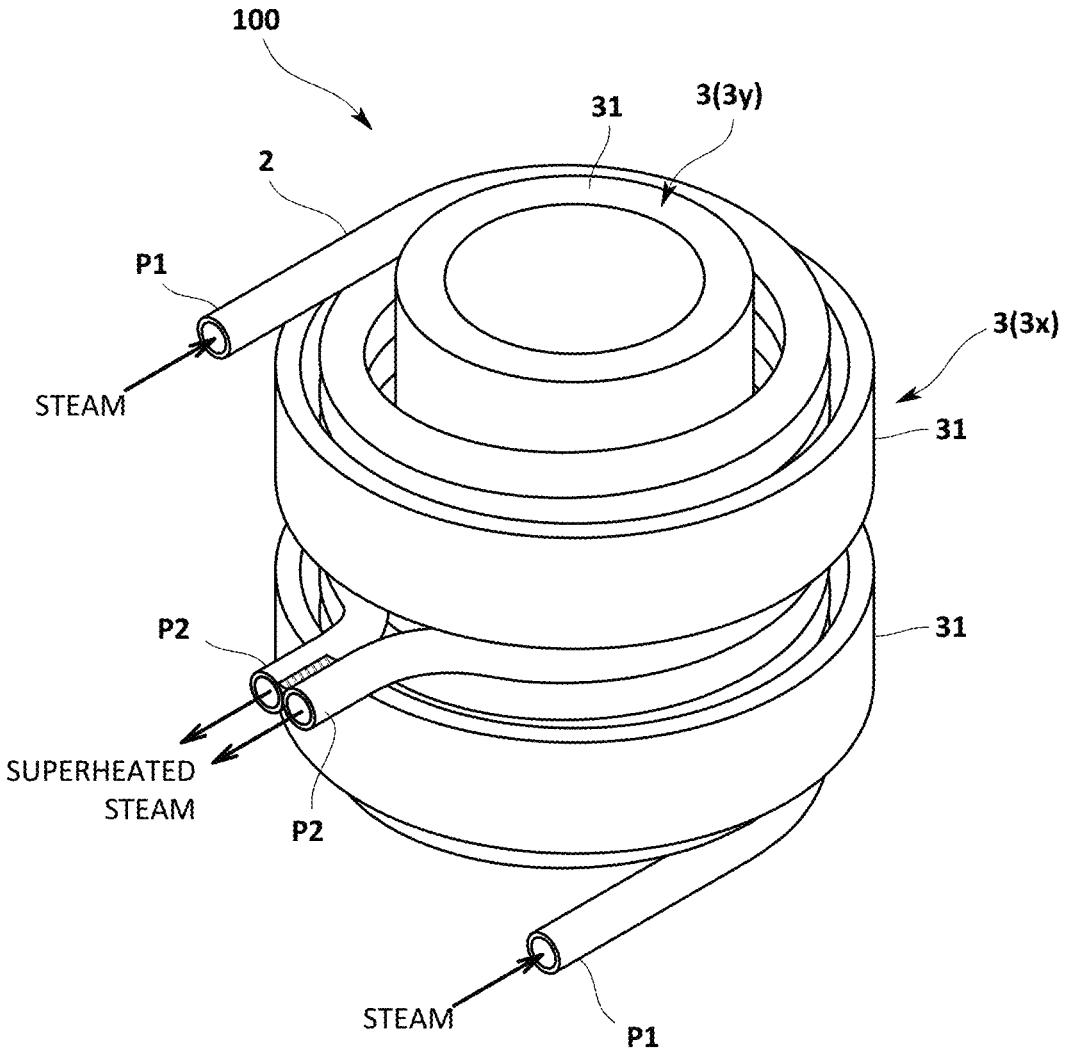
FIG. 1 is a perspective view schematically illustrating a configuration of a superheated steam generator in one of embodiments of the present invention.
Figure 2:
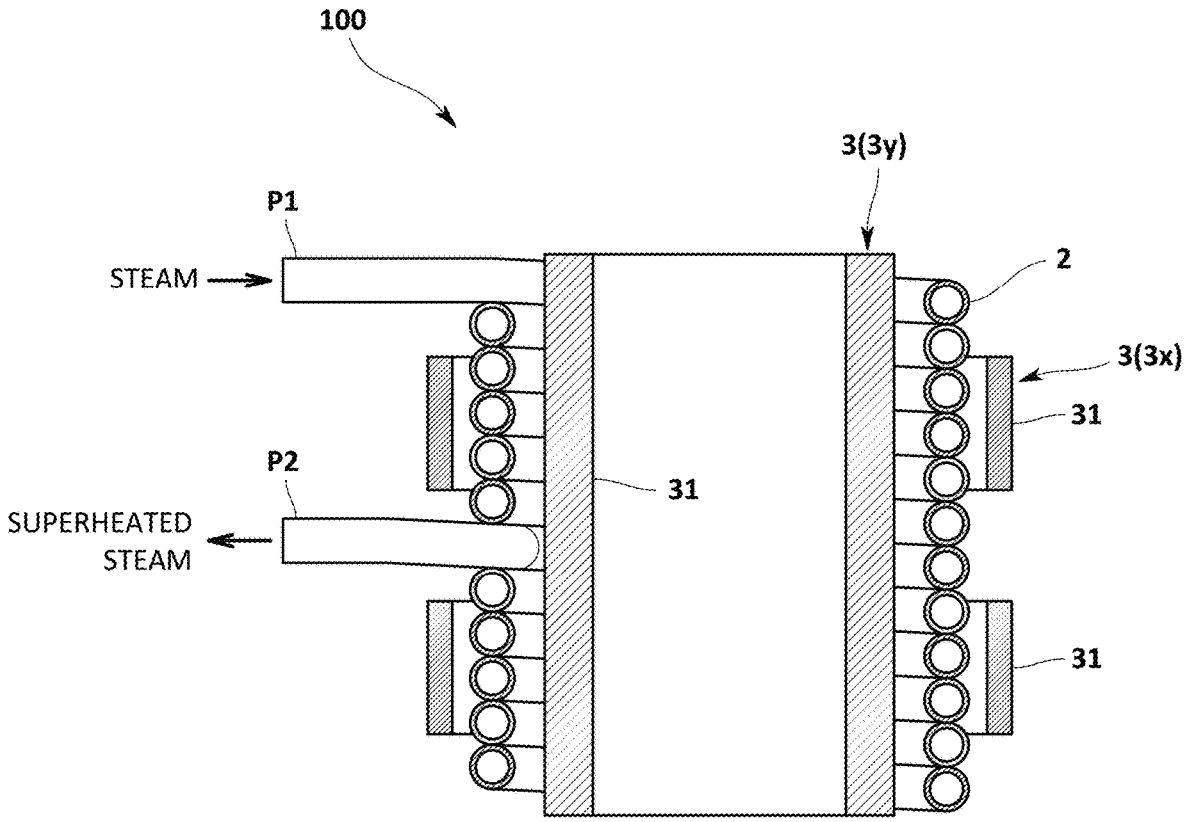
FIG. 2 is a sectional view schematically illustrating the superheated steam generator in the embodiment.

Specifically, the superheated steam generator 100 includes a spirally wound conductor tube 2 and a magnetic flux generation mechanism 3 by which the conductor tube 2 is subjected to induction heating as illustrated in FIGS. 1 and 2.

The conductor tube 2 is one which is obtained by spirally winding a conductive tube into a cylindrical shape, and which is axially short-circuited. The conductor tube 2 includes input ports P1 through which steam is inputted, and output ports P2 through which superheated steam is outputted. Winding parts corresponding to a single-turn of the conductor tube 2 are located contactedly or adjacently each other. For example, austenitic stainless steels and Inconel alloys are usable as a material of the conductor tube 2. A detailed configuration of the conductor tube 2 is described later.

The magnetic flux generation mechanism 3 is disposed inside and outside the conductor tube 2 and is intended to make the conductor tube 2 subjected to induction heating. The magnetic flux generation mechanism 3 includes an induction coil 31 disposed along an inner surface and a side surface of the conductor tube 2. Alternatively, the magnetic flux generation mechanism 3 may include a magnetic path forming member, such as an iron core (not illustrated). An AC voltage is applied to the induction coil 31 by an AC power source of a commercial frequency (50 Hz or 60 Hz, for example).

In the superheated steam generator 100 thus configured in the present embodiment, upon application of the AC voltage of 50 Hz or 60 Hz to the induction coil 31, an induction current flows through the conductor tube 2, so that the conductor tube 2 is subjected to Joule heating. Then, steam flowing through the conductor tube 2 is heated to generate superheated steam by receiving heat from the inner surface of the conductor tube 2.

As illustrated in FIGS. 1 to 5, the input ports P1 of the conductor tube 2 are respectively disposed at both axial end portions of the conductor tube 2, and output ports P2 of the conductor tube 2 are disposed at an axial midportion of the conductor tube 2 in the superheated steam generator 100 in the present embodiment. The output ports P2 in the present embodiment are disposed at positions in two parts obtained by axially equally dividing the conductor tube 2. However, there is no intention to limit thereto.

Figure 3:
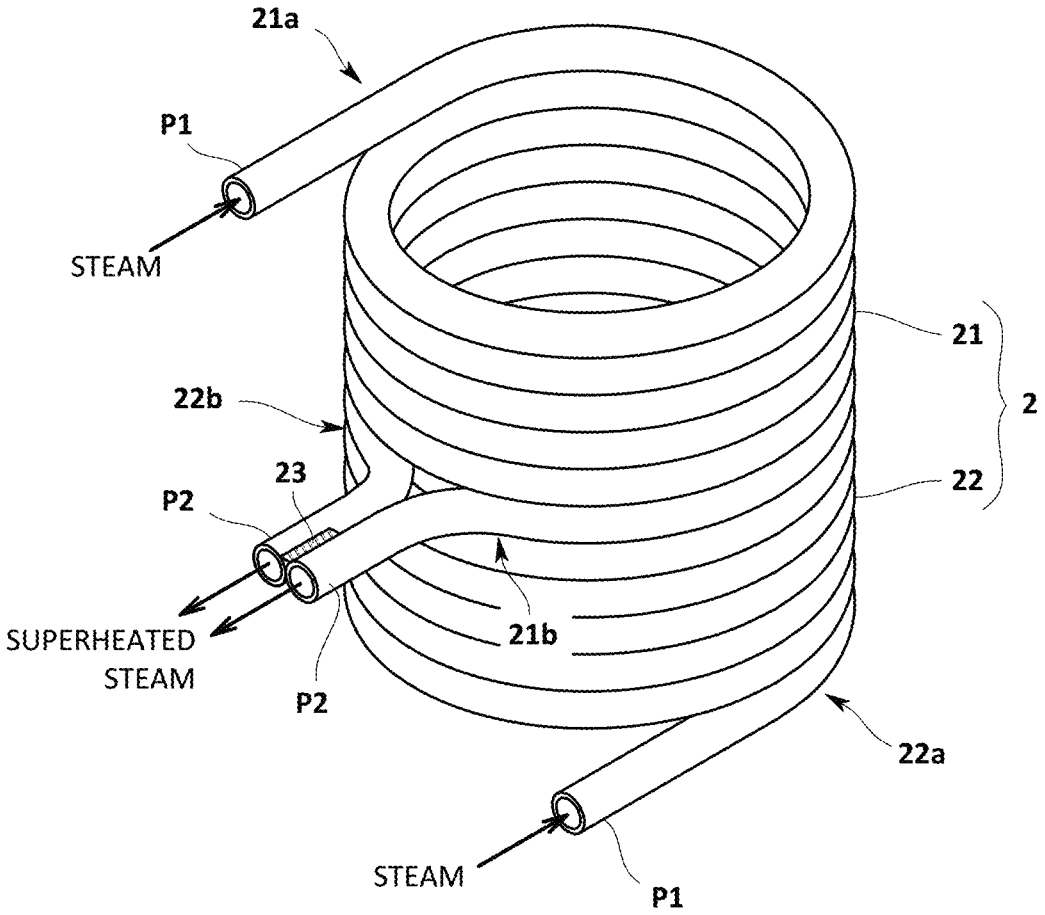
FIG. 3 is a perspective view schematically illustrating a configuration of a conductor tube in the embodiment.
Figure 4:
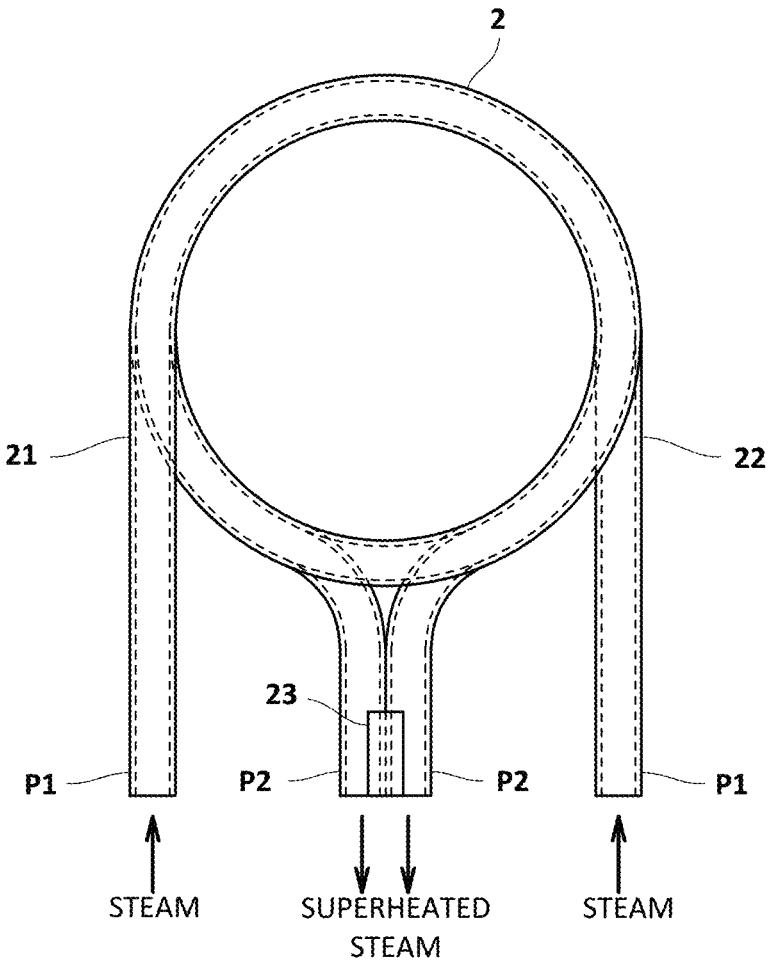
FIG. 4 is a plan view schematically illustrating the configuration of the conductor tube in the embodiment.
Figure 5:
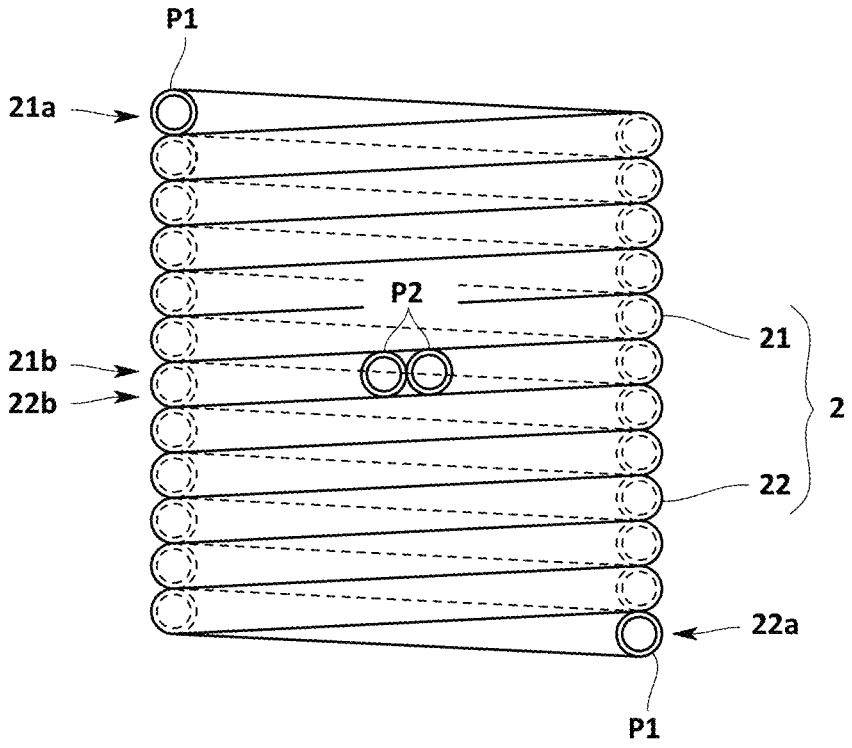
FIG. 5 is a front view schematically illustrating the configuration of the conductor tube in the embodiment.

Specifically, the conductor tube 2 is divided into two conductor tube elements 21 and 22 at an axial midportion as illustrated in FIGS. 3 to 5. The input ports P1 are respectively disposed at axial outer end portions 21*a* and 21*b* of the conductor tube elements 21 and 22. The output ports P2 are respectively disposed at axial inner end portions 21*b* and 22*b* of the conductor tube elements 21 and 22. By axially continuously disposing these two conductor tube elements 21 and 22, the input ports P1 of the conductor tube 2 are respectively disposed at both axial end portions of the conductor tube 2, and the output ports P2 of the conductor tube 2 are disposed at the axial midportions.

Winding parts adjacent to each other in the conductor tube elements 21 and 22 are electrically connected to each other, for example, by welding, and opposing parts adjacent to each other in the two conductor tube elements 21 and 22 are electrically connected to each other, thereby configuring a short circuit in the conductor tube 2 as a whole. Thus, the conductor tube 2 becomes a secondary single-turn coil. Although the conductor tube elements 21 and 22 have the same number of turns in the present embodiment, there is no intention to limit thereto.

The opposing parts of the two conductor tube elements 21 and 22, excluding the output ports P2, are joined together along the entire circumferential direction by a first joining element having electrical conductivity (not illustrated). The first joining element may be one which is formed by welding.

The output ports P2 of the conductor tube elements 21 and 22 are formed by bending the axial inner end portions 21*b* and 22*b* of the conductor tube elements 21 and 22 at a radius of curvature that is two times a tube diameter in the present embodiment as illustrated in FIG. 4. That is, the output ports P2 are formed by folding the winding parts of the conductor tube elements 21 and 22 in a radially outward direction.

The axially inner end portion 21*b* of the conductor element 21 and the axial inner end portion 22*b* of the conductor tube element 22 are designed to approach each other in the circumferential direction. The output ports P2 of the two conductor tube elements 21 and 22 are disposed contactedly or adjacently each other.

Figure 6A:
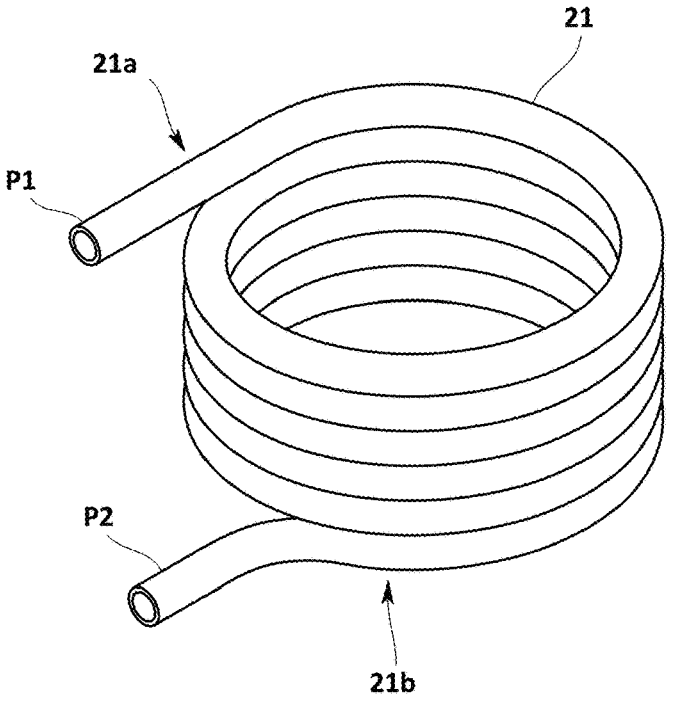
FIGS. 6A and 6B are top and bottom perspective views, respectively, illustrating a state in which individual conductor tube elements in the embodiment are separated from each other.
Figure 6B:
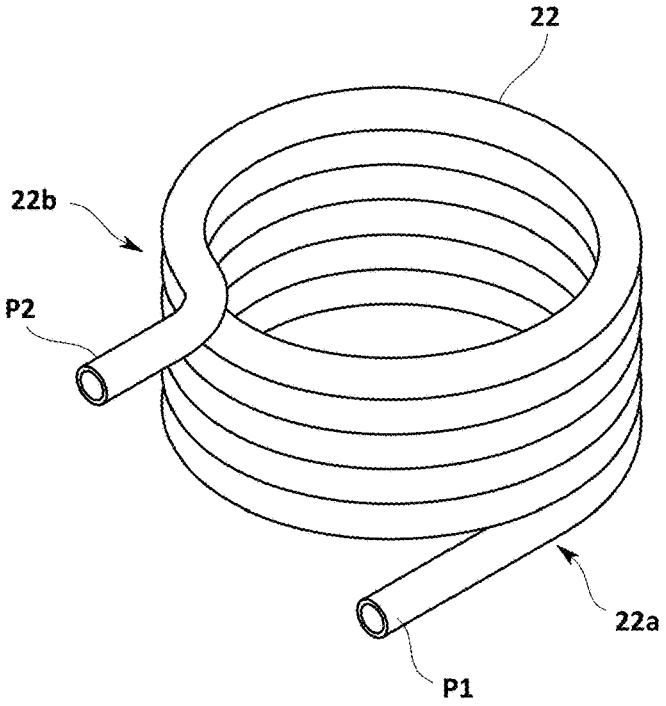
Figure 7:
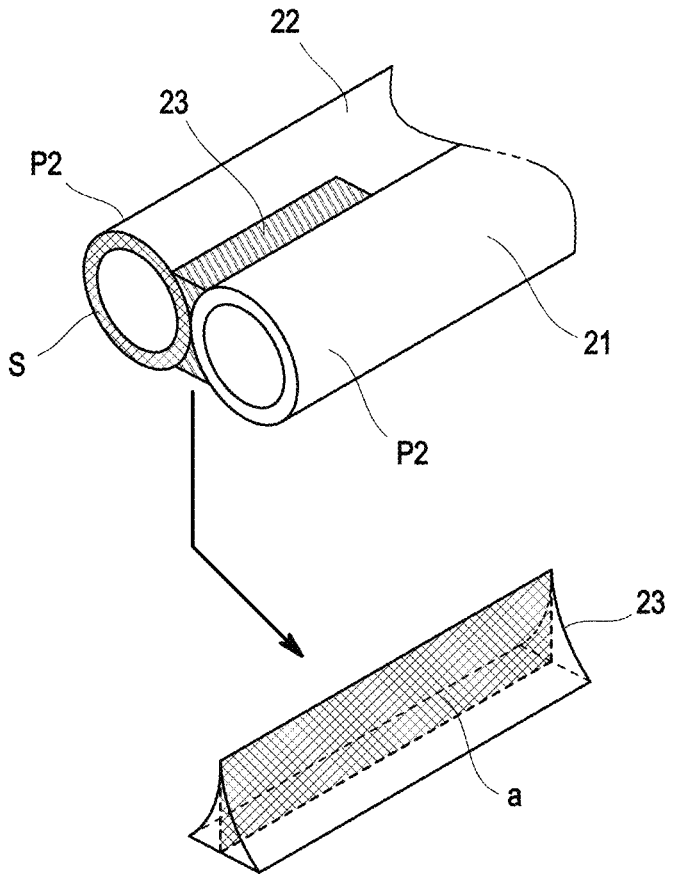
FIG. 7 is a perspective view illustrating output ports and a second joining element in the embodiment.

The two output ports P2 are electrically joined together by a second joining element 23 having electrical conductivity as illustrated in FIGS. 6A and 6B. The two output ports P2 are joined together by the second joining element 23 so as to fill clearance formed between the two output ports P2. The second joining element 23 is composed of a material equivalent to that of the conductor tube 2 or has substantially equivalent physical properties to that of the conductor tube 2. A total cross-sectional area 2*a* in an energizing direction of the second joining element 23 is set to be greater than a conductor cross-sectional area S of the conductor tube 2 (2*a*>S). The total cross-sectional area "a" in the energization direction is a cross-sectional area in a direction orthogonal to an opposing direction of the conductor tube 2 in the second joining element 23. In cases where the second joining element 23 is disposed only at one of upper and lower parts of the output ports P2, the total cross-sectional area in the energizing direction reaches "a."

As illustrated in FIGS. 1 and 2, the magnetic flux generation mechanisms 3 are respectively disposed inside and outside the conductor tube 2 thus configured. The magnetic flux generation mechanism 3*x* disposed outside the conductor tube 2 (at a pullout side of the output port P2) is axially divided so as to be respectively disposed on upper and lower sides of the output port P2. The magnetic flux generation mechanism 3*y* disposed inside the conductor tube 2 (on an opposite side of the pullout side of the output port P2) has an integral structure without being axially divided.

Figure 8A:
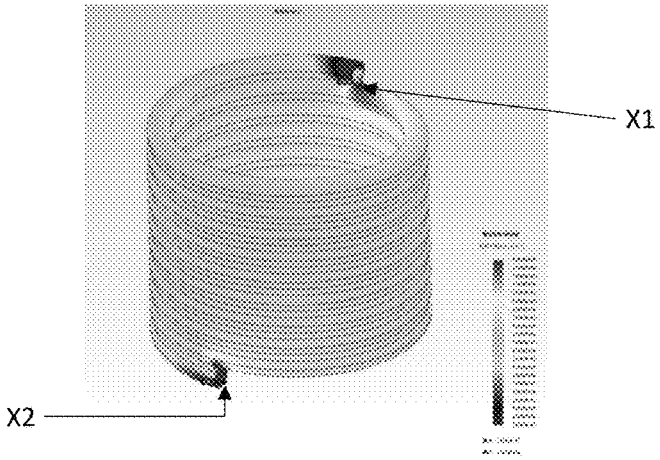
FIGS. 8A-8C show a simulation result illustrating a current density distribution in the conductor tube in the embodiment.
Figure 8B:
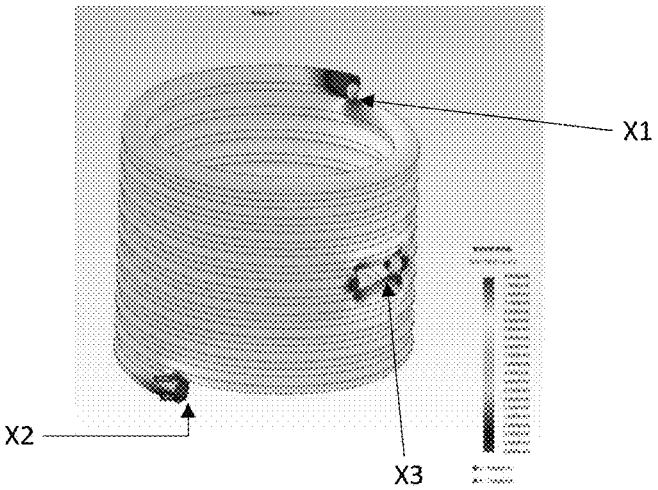
Figure 8C:
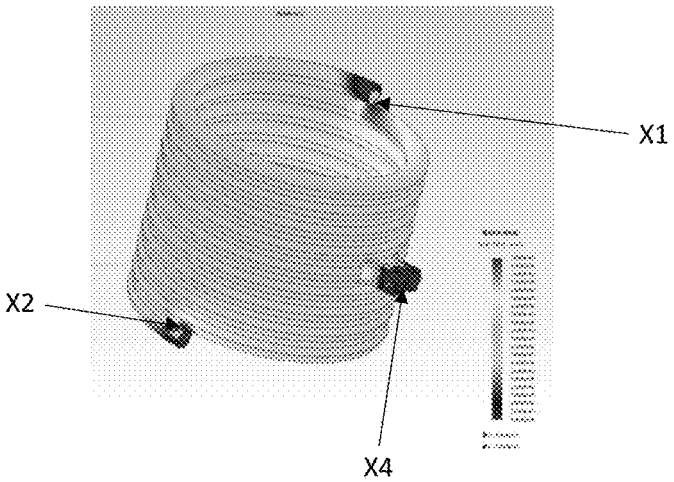
Figure 9:
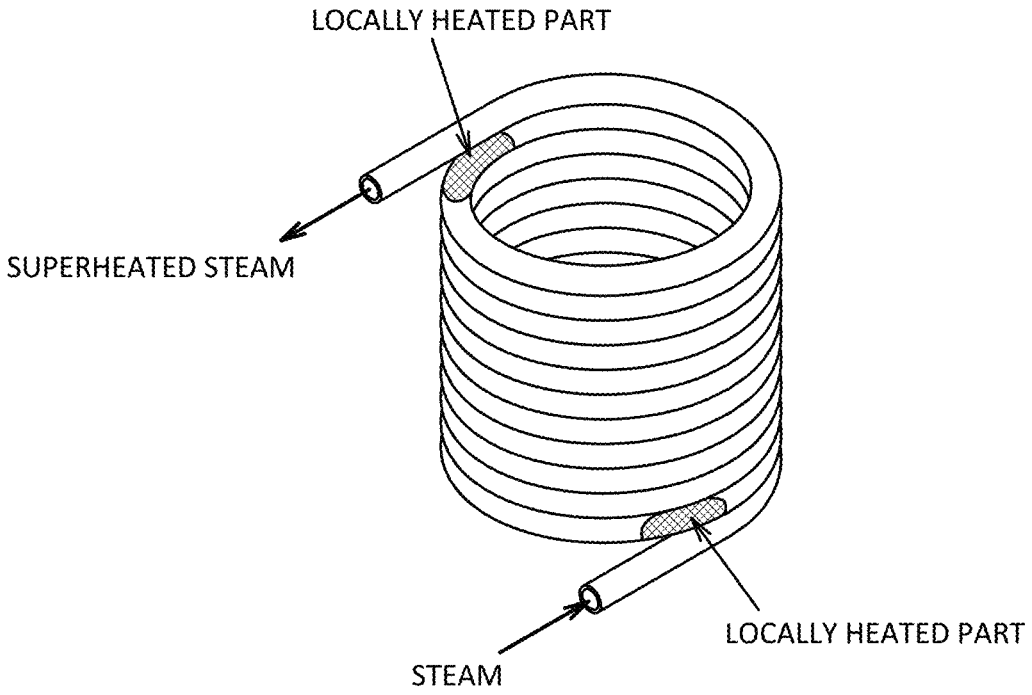
FIG. 9 CONVENTIONAL ART
FIG. 9 is a simulation result illustrating a current density distribution in a conventional conductor tube.

FIGS. 8A to 8C illustrate a simulation result of a current density distribution when the conductor tube 2 in the present embodiment is subjected to induction heating. Specifically, FIG. 8A illustrates a simulation result for a conductor tube having a conventional configuration. FIG. 8B illustrates a simulation result when the conductor tube 2 is divided into two. FIG. 8C illustrates a simulation result of the conductor tube 2 in the present embodiment.

Any one of FIGS. 8A to 8C shows that a current density becomes higher in the vicinity of the opening of both axial end portions X1, X2. FIG. 8B shows that the current density becomes higher at the upper and lower winding parts X3 which interpose therebetween clearance between divided parts. FIG. 8C shows that the current density at the output port X4 and the current density in the vicinity of the output port X4 are decreased by pulling the output ports X4 out of the axial midportions and by short-circuiting them.

2. Effects of Present Embodiment

With the superheated steam generator 100 thus configured, the output ports P2 are disposed at the axial midportions of the cylindrical conductor tube 2 subjected to induction heating. It is therefore possible to separate the positions of the output ports P2 from both end portions that are locally heated by the induction heating. Both of the locally heated end portions are less susceptible to heat deterioration due to further heating by superheated steam. Additionally, because the winding parts adjacent to each other are connected to the winding parts having the output ports P2 formed thereon, heat of the output ports P2 can be dispersed into the winding parts adjacent to each other, thereby reducing the heat deterioration. It is consequently possible to prevent lifetime degradation of the conductor tube 2.

The locally heated axial end portions can be held at low temperatures by steam before being heated because the input ports P1 of the conductor tube 2 are respectively disposed at both axial end portions of the conductor tube 2 in the present embodiment.

The input ports P1 and the output ports P2 are formed by axially arranging the conductor tube 2 at the two conductor tube elements 21 and 22 in the present embodiment. This contributes to simplifying the configuration and arranging the input ports and the output ports at desired positions.

The opposing parts of the two conductor tube elements 21 and 22, excluding the output ports P2, are joined together by the first joining element along the entire circumferential direction in the present embodiment. The current flowing through the conductor tube elements 21 and 22 can therefore be made uniform in the circumferential direction, thereby reducing the local heating. Additionally, because the two conductor tube elements 21 and 22 have substantially the same configuration, such as length, the opposing parts joined together by the first joining element have similar temperatures. This contributes to reducing mechanical power, such as a difference in thermal elongation. The conductor tube 2 is therefore less likely to deteriorate.

Because the output ports P2 of the conductor tube elements 21 and 22 are formed by bending the axial inner end portions 21*b* and 22*b* of the conductor tube elements 21 and 22 at a radius of curvature that is two times the tube diameter, the two output ports P2 can be arranged adjacently each other, thereby minimizing the clearance between the two conductor tube elements 21 and 22. This contributes to reducing a local increase in current density, thereby reducing the local heating.

Furthermore, because the two output ports P2 are joined together by the second joining element 23, short circuit current goes around and flows through joined parts, thereby reducing the local increase in current density. That is, the local heating is reducible. In this case, a short-circuit current value close to that in an undivided state can be ensured by such a configuration that the total cross-sectional area 2*a* in the energizing direction of the second joining element 23 is greater than the conductor cross-sectional area S of the conductor tube 2. Additionally, because the second joining element 23 is composed of the material equivalent to that of the conductor tube 2 or has substantially equivalent physical properties to that of the conductor tube 2, mechanical characteristics, such as thermal elongation, can be made to be equivalent thereto while ensuring an electric resistance lower than that of the conductor tube 2.

The local heating on the inside of the conductor tube 2 is reducible because the magnetic flux generation mechanism 3*y* disposed inside the conductor tube 2 has the integral structure without being axially divided.

3. Modified Embodiment of the Present Invention

The present invention is not limited to the above embodiment.

For example, even though the conductor tube 2 is composed of the two conductor tube elements 21 and 22 in the above embodiment, the conductor tube 2 may be composed of three or more conductor tube elements.

Although the output ports P2 are formed by dividing the conductor tube 2 in the above embodiment, the output ports P2 may be formed, instead of dividing the conductor tube 2, by forming, on a side wall, openings at midportions of the conductor tube 2 and by coupling output tubes serving as the output ports P2 to the openings.

Although the output ports are pulled radially outward in the above embodiment, the output ports may be designed to be pulled radially inward. In this case, the magnetic field generation mechanism disposed inside the conductor tube has an axially divided structure, and the magnetic field generation mechanism disposed outside the conductor tube has an integral structure without being divided axially.

Besides the above, the present invention is not limited to the foregoing embodiments, and various modifications may be made without departing from the spirit and scope of the present invention.

DESCRIPTION OF THE REFERENCE CHARACTERS

100 superheated steam generator
2 conductor tube
3 magnetic field generation mechanism
P1 input port
P2 output port
21, 22 conductor tube element
21*a*, 22*a* axial outer end portion
21*b*, 22*b* axial inner end portion
23 joining element

What is claimed is:

1. A superheated steam generator configured to generate superheated steam by heating steam, the superheated steam generator comprising:

a spirally wound cylindrical conductor tube through which the steam flows; and a magnetic flux generation mechanism disposed on one or both of inner and outer sides of the conductor tube, wherein the conductor tube is axially short-circuited and subjected to induction heating by the magnetic flux generation mechanism to thereby generate the superheated steam, and an output port of the conductor tube is disposed at an axial midportion of the conductor tube.

2. The superheated steam generator according to claim 1, wherein input ports of the conductor tube are disposed at both axial end portions of the conductor tube.

3. The superheated steam generator according to claim 2, wherein the conductor tube is divided at an axial midportion into two conductor tube elements, the input ports are disposed at an axial outer end portion of each of the conductor tube elements, and the output port is one of two output ports disposed at an axial inner end portion of each of the conductor tube elements.

4. The superheated steam generator according to claim 3, wherein winding parts of the conductor tube elements adjacent to each other are electrically connected to each other and opposing parts of the two conductor tube elements adjacent to each other are electrically connected to each other so as to configure a short circuit in the conductor tube as a whole.

5. The superheated steam generator according to claim 4, wherein opposing parts of the two conductor tube elements, excluding the output ports, are joined together by a first conductive joining element along an entire circumferential direction.

6. The superheated steam generator according to claim 3, wherein the output port of each of the conductor tube elements is formed by bending an axial inner end portion of each of the conductor tube elements at a radius of curvature that is two times a tube diameter.

7. The superheated steam generator according to claim 3, wherein the output ports of the two conductor tube elements are disposed contactedly or adjacently each other.

8. The superheated steam generator according to claim 3, wherein the two output ports are joined together by a second conductive joining element.

9. The superheated steam generator according to claim 8, wherein the second joining element is composed of a material equivalent to that of the conductor tube or has substantially equivalent physical properties to that of the conductor tube, and a total cross-sectional area in an energizing direction of the second joining element is set to be greater than a conductor cross-sectional area of the conductor tube.

10. The superheated steam generator according to claim 1, wherein at least one of the magnetic flux generation mechanisms is disposed on an opposite side of a pullout side of the output port, and the at least one magnetic flux generation mechanism has an integral structure without being divided axially.

* * * * *